US011116278B2

(12) United States Patent
Gorza et al.

(10) Patent No.: US 11,116,278 B2
(45) Date of Patent: Sep. 14, 2021

(54) ALPINE OR MOUNTAINEERING SKI BOOT WITH IMPROVED SKI-WALK MECHANISM

(71) Applicant: OBER ALP S.p.A, Bolzano (IT)

(72) Inventors: Roberto Gorza, Bolzano (IT); Claudio Zorzi, Bolzano (IT)

(73) Assignee: OBER ALP S.p.A, Bolzano (IT)

( * ) Notice: Subject to any disclaimer, the term of this patent is extended or adjusted under 35 U.S.C. 154(b) by 125 days.

(21) Appl. No.: 15/994,885

(22) Filed: May 31, 2018

(65) Prior Publication Data

US 2018/0368508 A1 Dec. 27, 2018

(30) Foreign Application Priority Data

Jun. 26, 2017 (IT) ..... 102017000071140

(51) Int. Cl.
*A43B 5/04* (2006.01)
*A43B 23/02* (2006.01)

(52) U.S. Cl.
CPC ..... *A43B 5/0474* (2013.01); *A43B 5/0496* (2013.01); *A43B 23/0245* (2013.01)

(58) Field of Classification Search
CPC ..... A43B 5/047; A43B 5/0474; A43B 5/0496; A43B 23/0245
USPC ..... 36/118.2, 118.3, 118.4, 118.7, 118.8, 36/118.9
See application file for complete search history.

(56) References Cited

U.S. PATENT DOCUMENTS 4,083,129 A * 4/1978 Collombin ..... A43B 5/0454 36/118.2
5,083,348 A * 1/1992 Gorza ..... A43B 5/0415 24/68 SK
2002/0029497 A1* 3/2002 Pierce ..... A43B 5/0456 36/118.3

(Continued)

FOREIGN PATENT DOCUMENTS

DE 3506057 A1 2/1986
EP 1332689 A1 8/2003

(Continued)

OTHER PUBLICATIONS

Italian Search Report in IT201700071140 dated Mar. 7, 2018.

*Primary Examiner* — Khoa D Huynh
*Assistant Examiner* — Erick I Lopez
(74) *Attorney, Agent, or Firm* — Henry J. Cittone; Cittone Demers & Arneri, LLP

(57) ABSTRACT

A ski boot composed of a lower part or foot portion and an upper part or leg portion, suitable to enclose the lower part of the skier's leg, wherein the leg portion is hinged to the foot portion so as to rotate with respect to the foot portion around hinges defining a rotation axis. The leg portion comprises a closing lever suitable to block and/or unblock selectively the rotation of the leg portion with respect to the foot portion, and operatively connected to a base and an arm engageable in abutment against a pin fixed to the foot portion. The closing lever in the open configuration mutually moves the base and the arm away from each other forcing the latter against the pin to prevent a rotation of the leg portion backwards. The boot comprises traction means which operatively connect the base, the arm, and a fastening on the foot portion, the arm being placed between the base and the fastening. Said traction means comprise a cable at least partially extensible.

15 Claims, 8 Drawing Sheets

(56) References Cited

U.S. PATENT DOCUMENTS

2014/0013629 A1* 1/2014 Haugen ..... A43B 5/0496
36/117.1

FOREIGN PATENT DOCUMENTS

| | | | |
|---|---|---|---|
| EP | 2777414 | A1 | 9/2014 |
| EP | 3090641 | A1 | 11/2016 |
| EP | 3097807 | A1 | 11/2016 |
| EP | 3175730 | A1 | 6/2017 |

* cited by examiner

ALPINE OR MOUNTAINEERING SKI BOOT WITH IMPROVED SKI-WALK MECHANISM

FIELD OF THE INVENTION

The present invention refers to an alpine or mountaineering ski boot equipped with an improved ski-walk mechanism.

DESCRIPTION OF THE PRIOR ART

Alpine or mountaineering ski boots must allow the skier to switch from the ski configuration to the walking configuration alternately and repeatedly in an easy, fast and comfortable way.

In particular, such boots comprise a leg portion, which embraces the tibial portion of the user's leg, hinged to a foot portion, which contains the user's foot and is provided with a sole.

In the skiing configuration, the leg portion is perfectly integral to the foot portion, i.e. it does not rotate with respect thereto, allowing safe and precise skiing.

In the walking configuration, the leg portion is unlocked from the foot portion: the rotation of the leg portion with respect to the foot portion thus ensures a better and more comfortable walk compared to traditional boots, since it follows the natural rotation of the ankle.

As seen, the rotation of the leg portion may be blocked and unblocked by attaching the leg portion to the foot portion reversibly.

The transition from the walking configuration to the skiing configuration should be as quick and easy as possible, since the skier, during alpine skiing, must switch between the two configurations many times, depending on the path to be taken.

PRESENTATION OF THE INVENTION

The main solutions of the prior art envisage hinging the leg portion to the foot portion and guiding the rotation movement thereof by at least one rod.

A first fixed end of the rod is hinged in turn to the foot portion, while a second free end slides within a guide attached to the leg portion.

In the walking configuration, the free end of the bar may slide inside the guide attached to the leg portion; moreover, in the walking configuration the rod may rotate around the first end so as to follow the rotation of the leg portion.

In the skiing configuration, the free end of the rod is attached to the guide and therefore to the leg portion.

The closure or locking of the rod may take place by means of a peg which engages with a hole positioned on the rod.

This type of solution has some drawbacks.

In effect, in the walking configuration, there is always a certain resistance to the rotation of the leg portion due to the fact that the free end of the locking rod rubs against its seat/portion of leg portion provided for housing/guiding it.

In other words, the rod tends to rub and get stuck inside the guide, making walking particularly tiring. The problem is further accentuated by the low operating temperatures and by the snow/ice which, during use, tend to further penetrate between the rod and the relative guide, making the displacement thereof increasingly difficult.

Moreover, the type of guide of the leg portion adopted by the prior solutions imposes strong limitations on the positions between the hinges of the reciprocal connection of the leg portion to the foot portion and the anchorages of the guide rod. These geometric limitations only partially limit the problem of the leg portion getting stuck but, on the other hand, create enormous constraints on the overall aesthetics and functionality of the boot.

Moreover, even in the skiing position, the known solutions never guarantee an adequate rigidity, for example comparable to that obtainable from an equivalent ski boot, in particular, the type with the leg portion attached or non-rotatable with respect to the foot portion.

In effect, the coupling between the peg/pin and the respective seat is inevitably of a free type and therefore implies the presence of play, even if limited.

Moreover, if there were no play, the locking operation would be inconvenient for the user, since the pin would occasionally get stuck in its seat.

The play, even if limited in the shaft/hole coupling, gives rise to a forward and backward movement of the shin with respect to the foot portion in the locked configuration, i.e. the skiing configuration. Moreover, this play also causes an annoying "click" every time one moves one's weight forward or backward; while skiing and/or changing direction, a corresponding shift in the leg portion is felt.

This play reduces the rigidity of the boot and certainly also the precision of skiing due to the fact that the user feels this "play", which is certainly not present in ski boots without movement in the leg portion (e.g. alpine ski boots).

To overcome this drawback, there are also solutions that provide for the use of limit stops which, in the locked configuration, are placed between the leg portion and the foot portion so as to prevent any rotation of the leg portion either forward or backward.

In this solution, in the locked configuration, the limit stops are pre-loaded in compression, so as to avoid any possible play.

These solutions, on the one hand, avoid the problem of troublesome play typical of embodiments with pins inserted into rods, and on the other, make the boot extremely rigid in the skiing configuration. Moreover, the unavoidable production/processing tolerances mean that some boots are excessively rigid in the skiing configuration, so much so that manually locking the leg portion to the foot portion is difficult.

Therefore, such known solutions are often characterized by excessive stiffness that may make the boot uncomfortable to use in the skiing configuration, inconvenient to lock, and more subject to breakages, because, if the limit stops are excessively preloaded, they may break during use.

In summary, the ski boot solutions of the prior art have an excessive resistance to the rotation movement of the leg portion during walking, and excessive play of the same leg portion during skiing.

In other words, walking is never easy because it is limited, and skiing is never as precise as that achieved with a corresponding ski boot, given the movement of the leg with respect to the foot portion even in the locked configuration.

Note that the two requirements, in particular the ease of walking and the precision of skiing, are often antithetical to the practicality of use: in effect, if on the one hand the rigid and precise closing mechanisms stiffen the structure of the boot, on the other, they are very easy for the user to use.

The ease of operation should never be overlooked because during an excursion the user must be able to lock/unlock the ski-walk mechanism even dozens of times in an hour without having to take off his/her gloves and often even without stopping.

Other known solutions guarantee the absence of play and good sliding of the leg portion during walking, but they are often too rigid in the skiing configuration and may be subject to breakage as a result of intense use and/or shocks.

The object of the present invention is to provide an alpine/mountaineering ski boot which solves the aforementioned drawbacks with respect to the known art.

These drawbacks and limitations are resolved with an alpine or mountaineering ski boot according to claim 1.

Other embodiments of the ski boot according to the invention are described in the subsequent claims.

DESCRIPTION OF THE DRAWINGS

Further characteristics and advantages of the present invention will be more clearly comprehensible from the description given below of the preferred, non-limiting embodiment, wherein.

Figure 2:
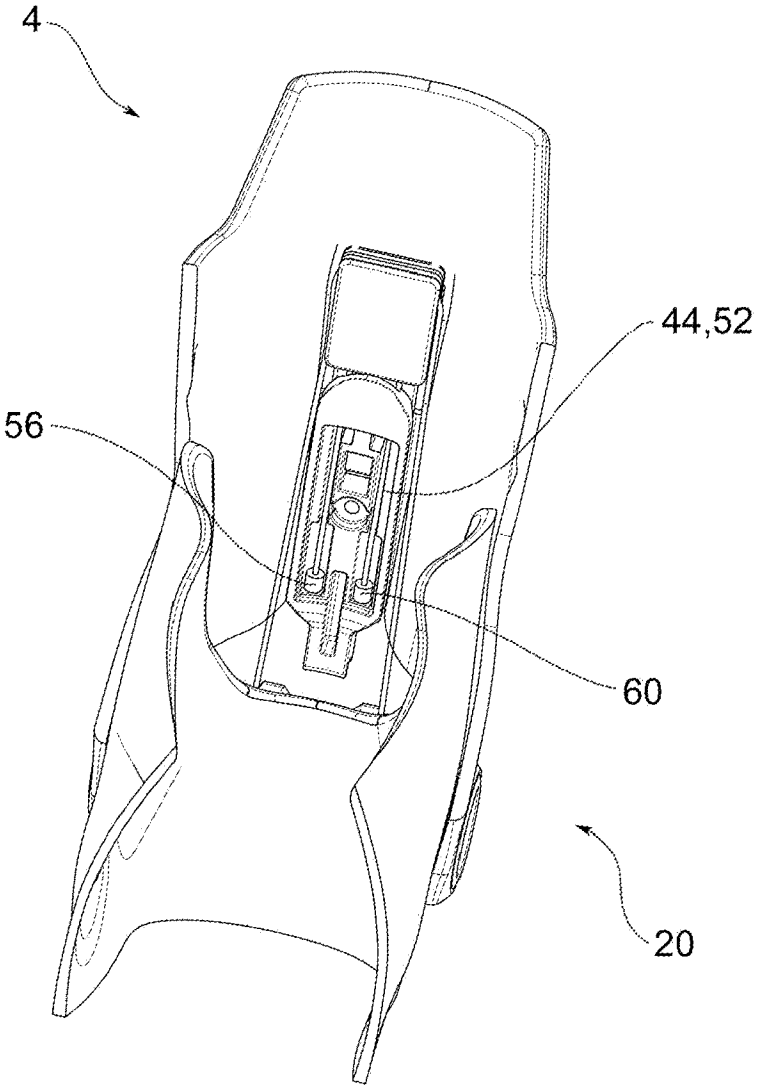
FIGS. 1-2 show partial perspective views, from different angles, of a ski boot according to an embodiment of the present invention, in an unlocked or walking configuration.
Figure 1:
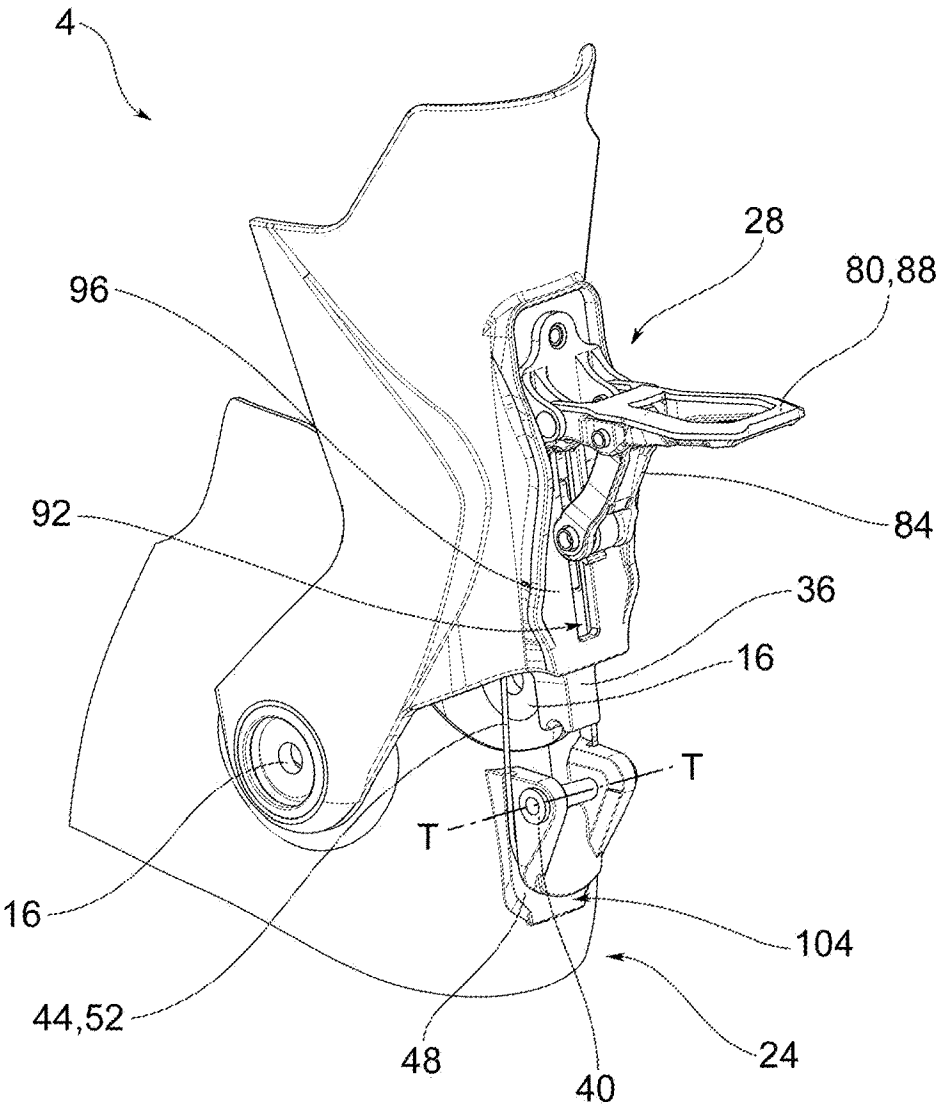
Figure 5:
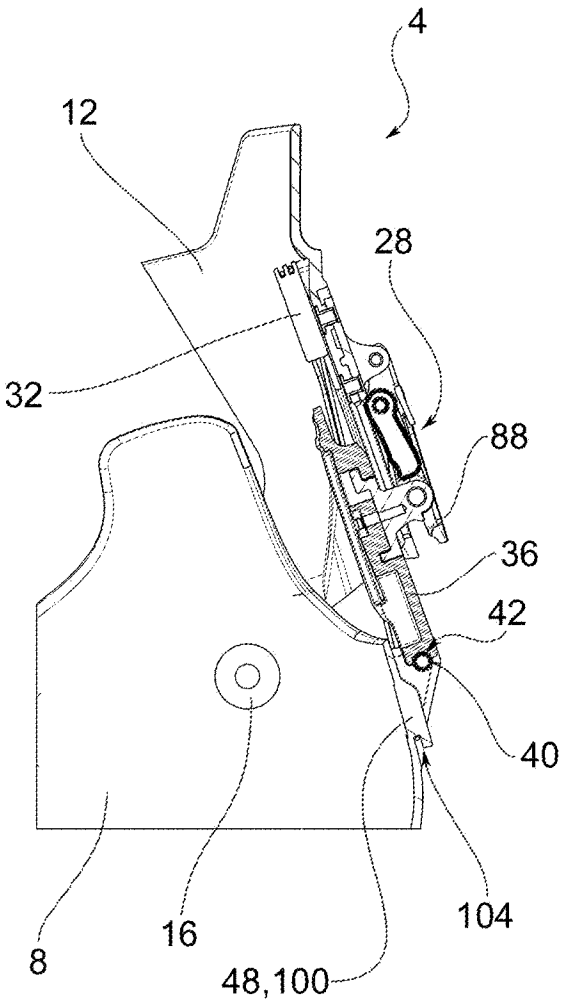
FIG. 5 shows a view in cross-section of the ski boot of FIG. 3 along the cross-sectional plane V-V indicated in FIG. 4.
Figure 4:
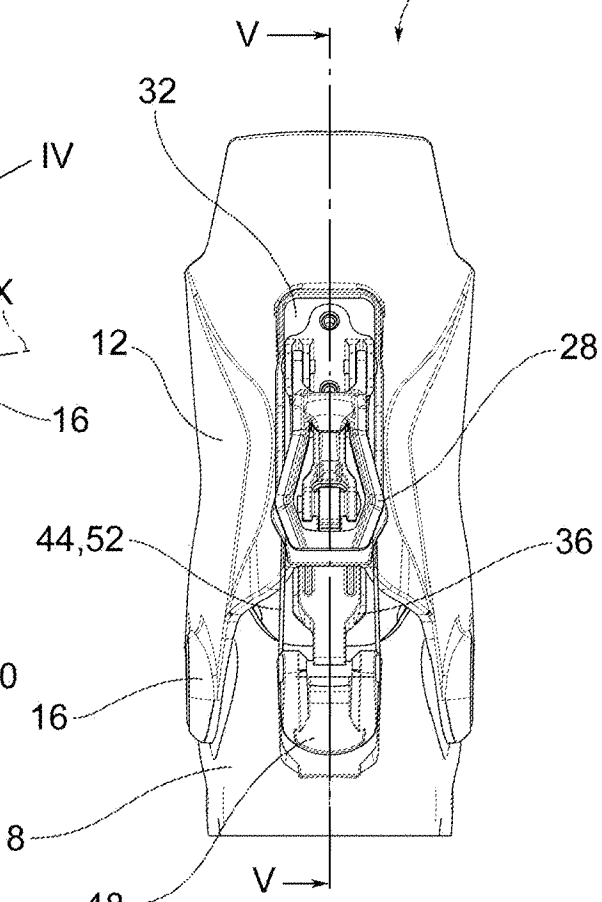
FIG. 4 shows a rear view of the boot of FIG. 3, from the direction of the arrow IV of FIG. 3.
Figure 3:
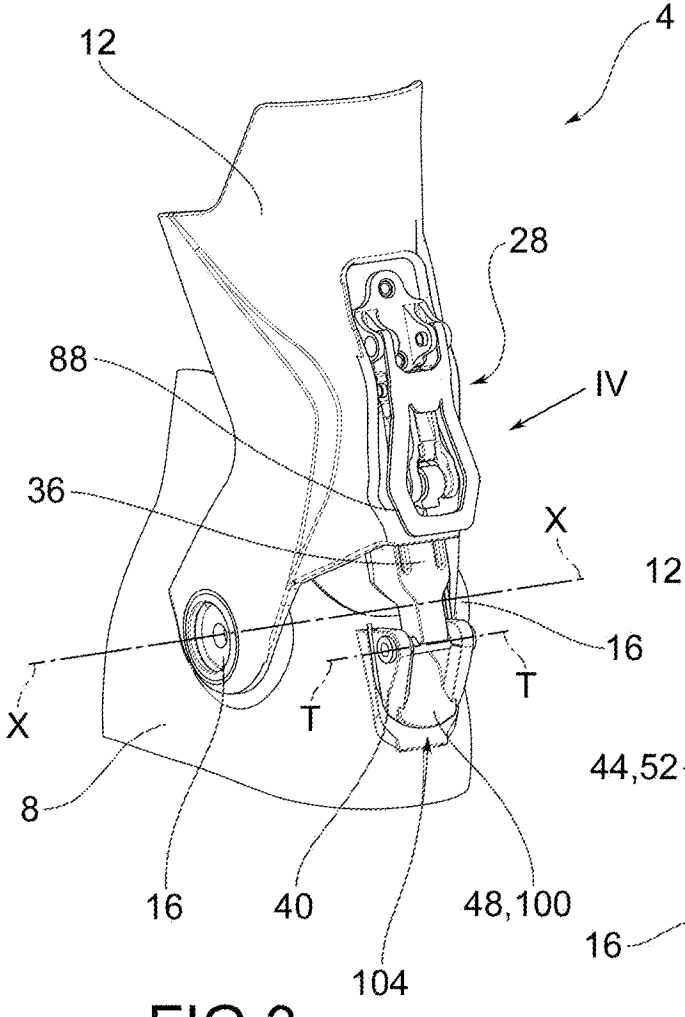
FIG. 3 shows a perspective view of the ski boot of FIG. 1, in a locked or skiing configuration.
Figure 6:
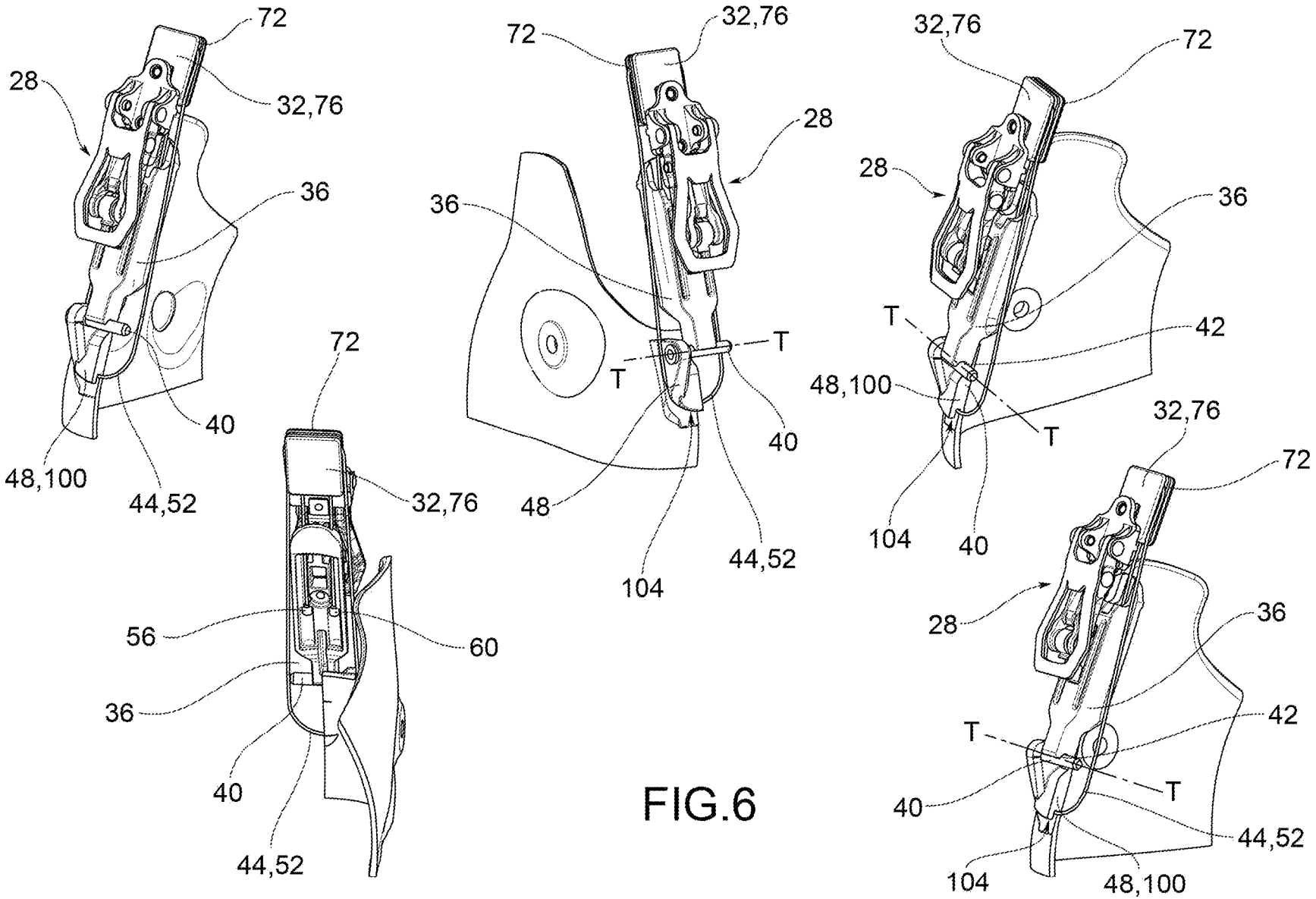
FIG. 6 illustrates various partial perspective views, with some details omitted, of a boot in the locked configuration.
Figure 7:
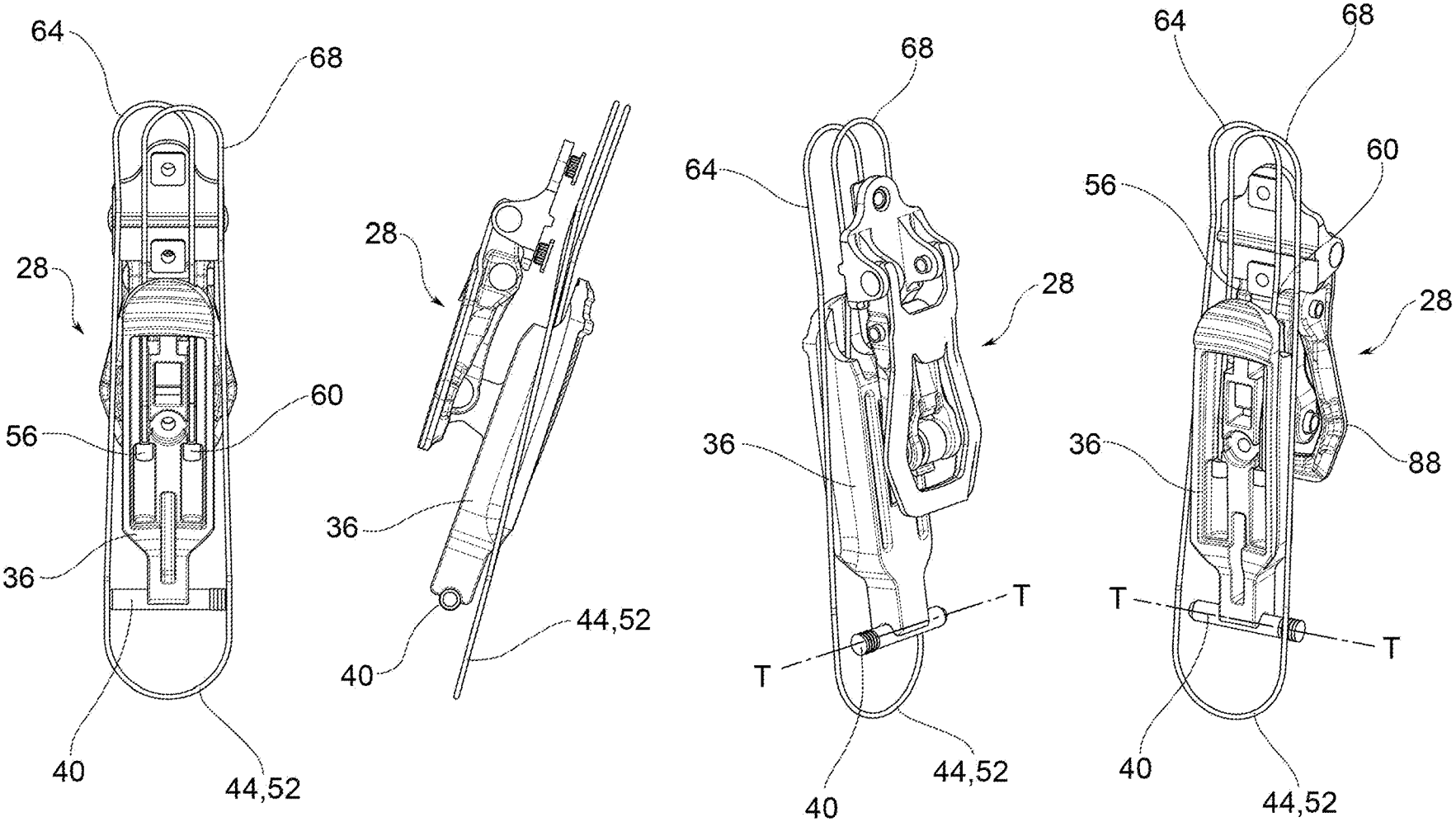
FIG. 7 illustrates various perspective views of a closing mechanism in the closed configuration according to the present invention.
Figure 8:
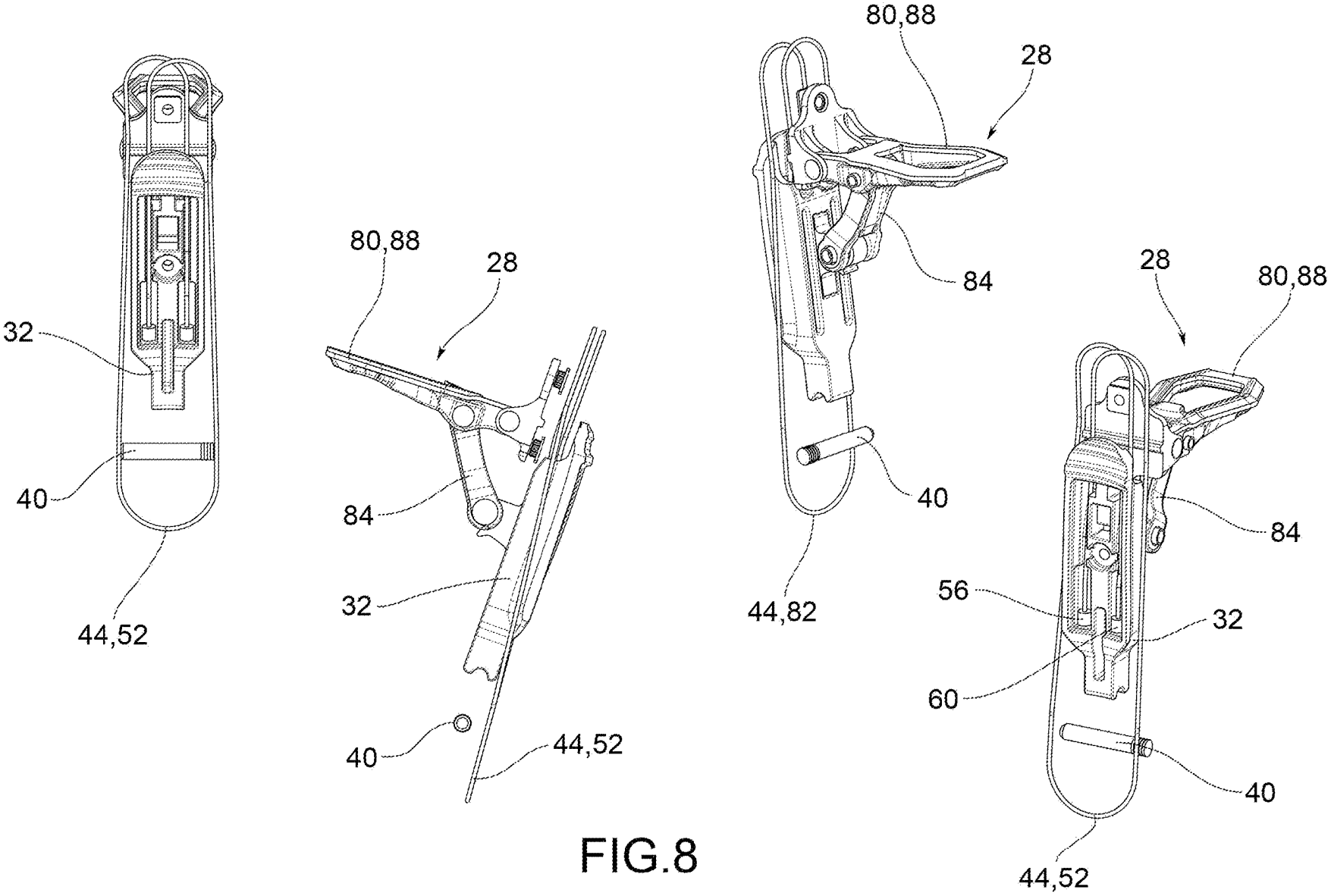
FIG. 8 shows various perspective views of the closing mechanism of FIG. 7 in the open configuration.
Figure 10:
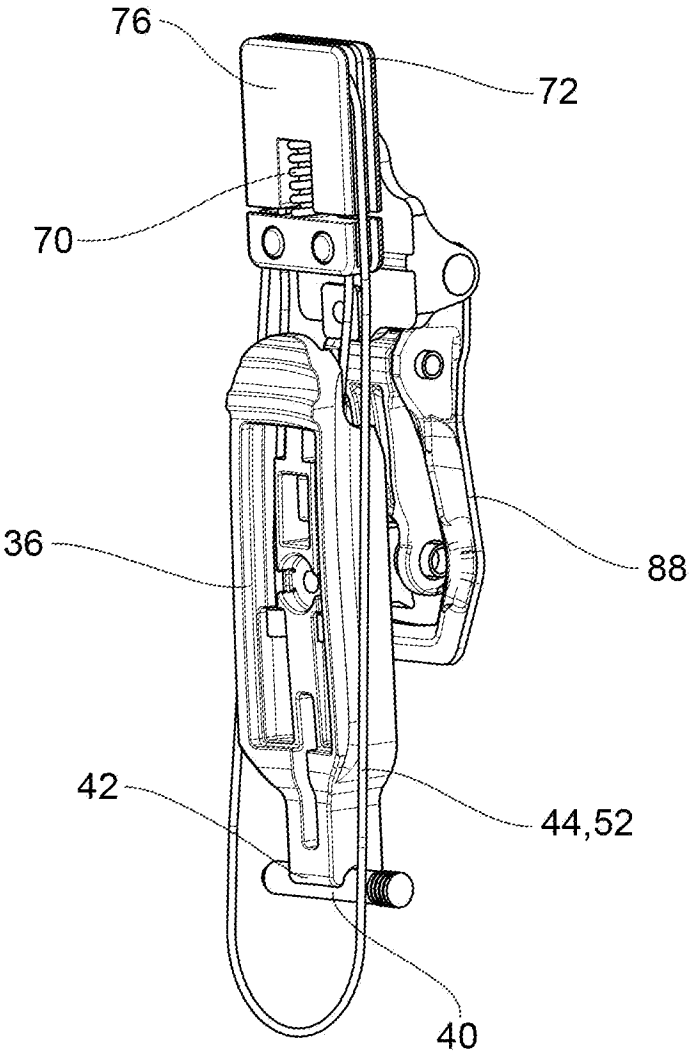
FIGS. 9-10 show perspective views of a closing mechanism respectively in an open and closed configuration according to a further embodiment of the present invention.
Figure 9:
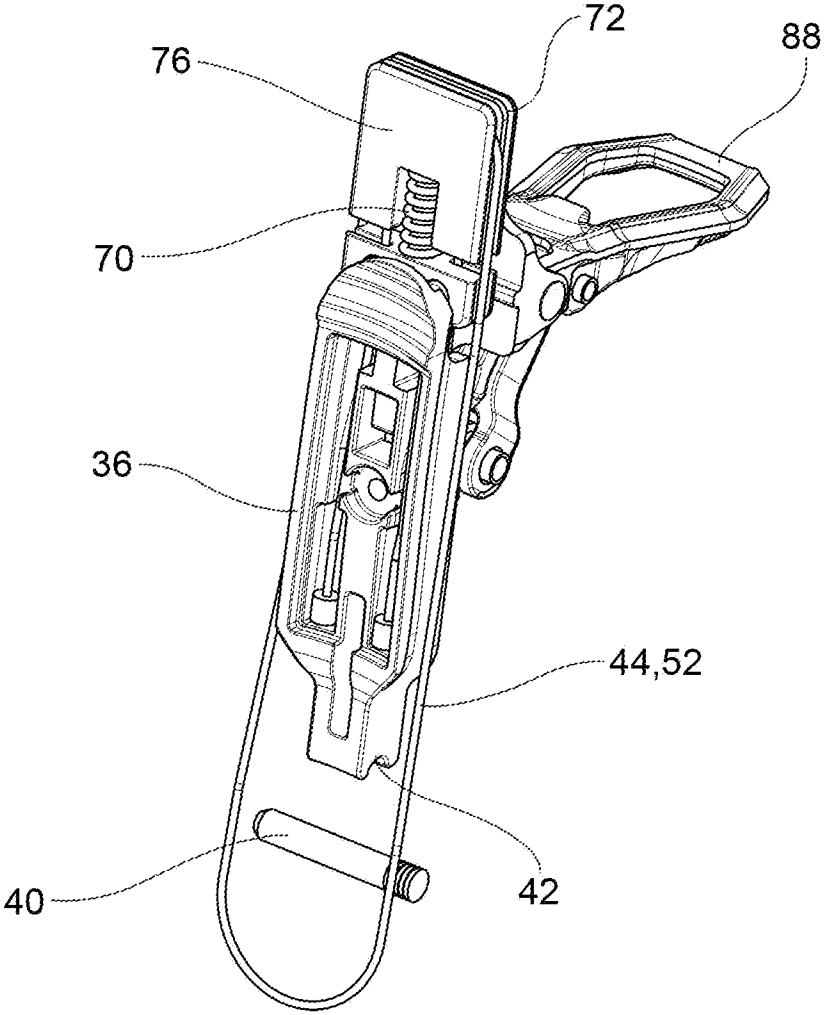
Figure 12:
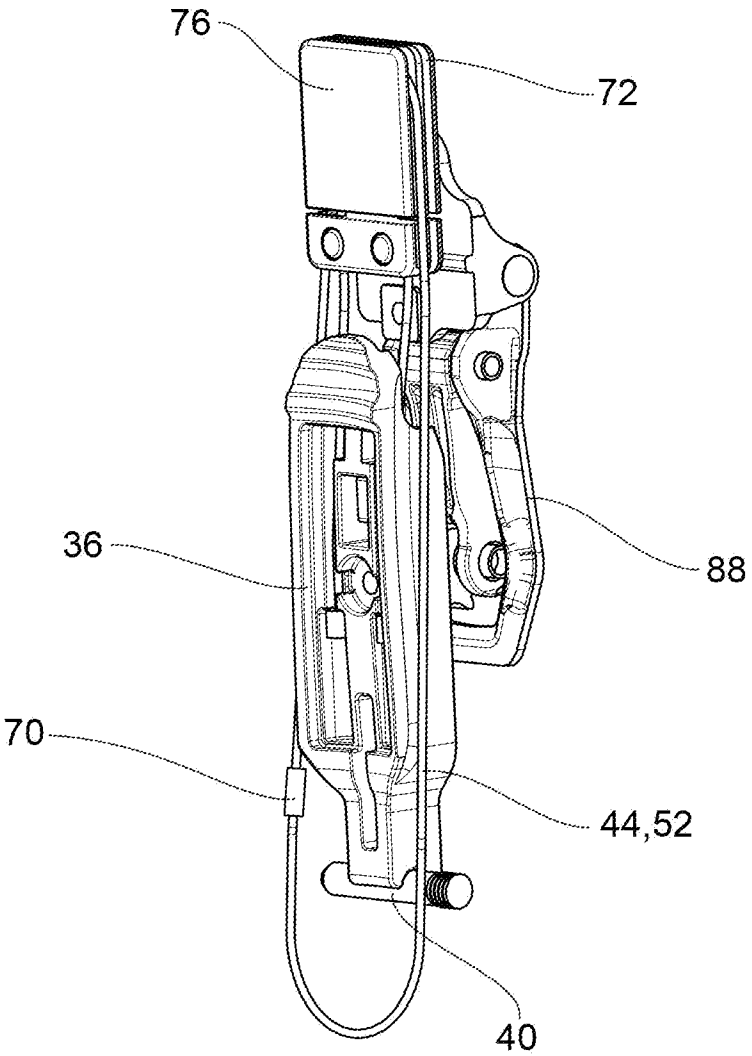
FIGS. 11-12 represent perspective views of a closing mechanism, respectively in an open and closed configuration, according to a further embodiment of the present invention.
Figure 11:
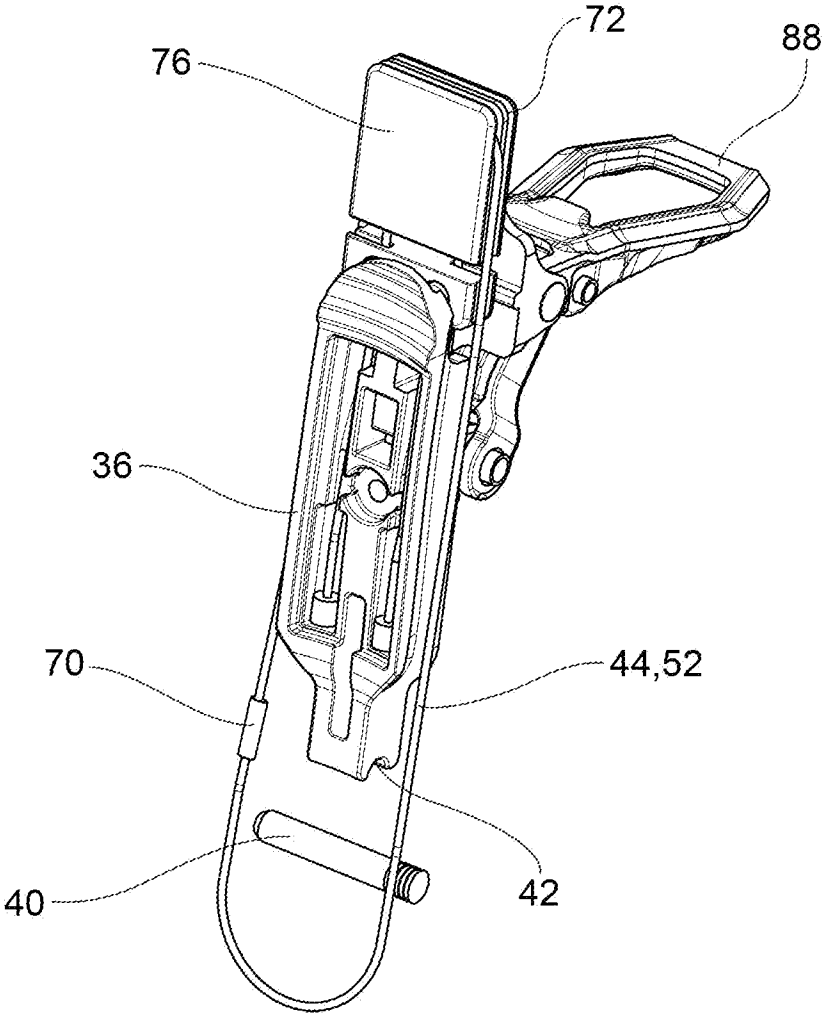
Figure 14:
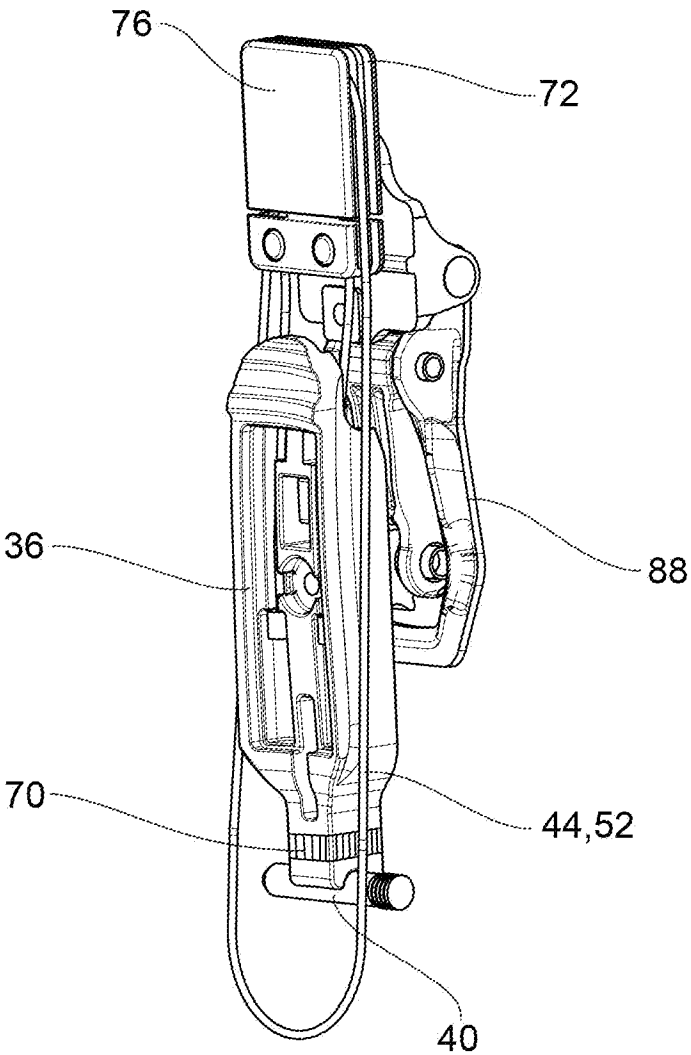
FIGS. 13-14 show perspective views of a closing mechanism respectively in an open and closed configuration according to a further embodiment of the present invention.
Figure 13:
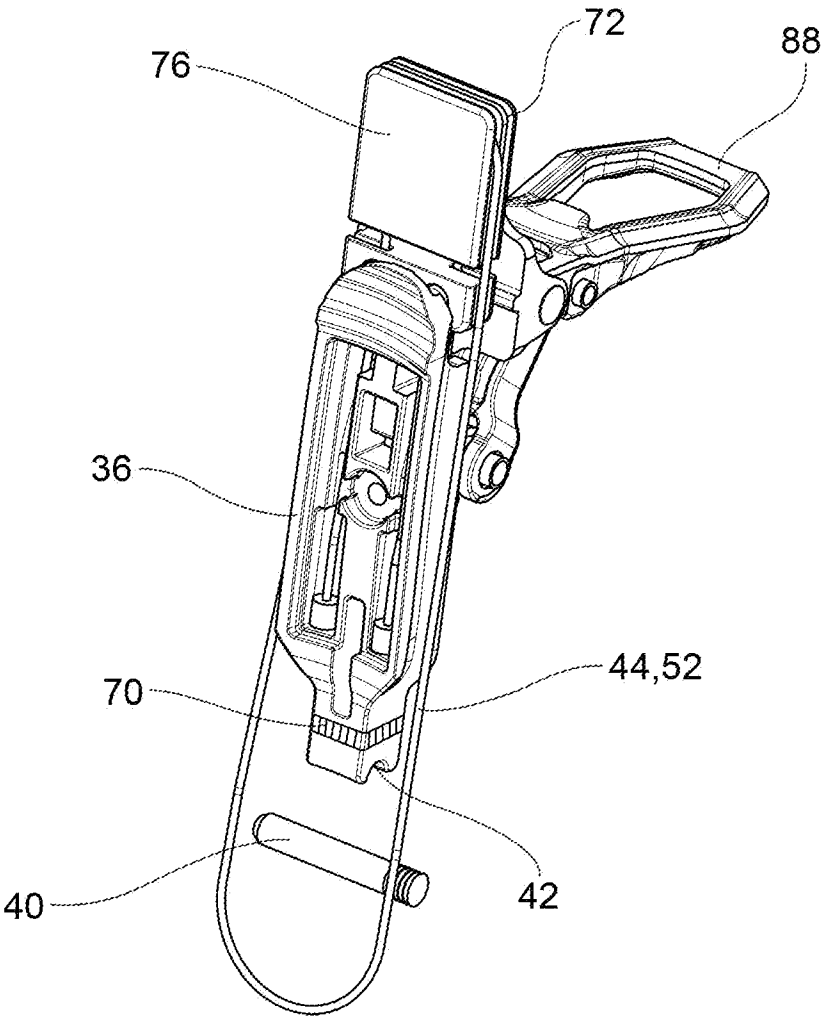

The elements or parts of elements in common between the embodiments described hereinafter will be indicated at the same numerical references.

DETAILED DESCRIPTION

With reference to the aforementioned figures, a ski boot comprising a lower part or foot portion 8, suitable for enclosing the user's foot, and an upper part or leg portion 12, suitable for enclosing the lower part of the skier's leg is indicated at number 4.

It should be noted that the definition of a ski boot should be considered in a general and non-restrictive way; therefore, the term "ski boot" refers to an alpine ski boot, ski mountaineering boot or even a "Telemark" ski boot.

The scope of the protection of the present invention is therefore not limited to a specific type of ski boot.

Moreover, also the definitions of the foot portion and the leg portion must be considered in a general and non-restrictive manner: the present invention does not present any kind of limitation with respect to the shapes, sizes, materials, or type of leg portion or foot portion, and therefore also types of leg portions and foot portions which at least partially enclose the foot and the lower part of the leg, in particular the skier's shin, fall within the scope of the invention.

The leg portion 12 is hinged to the foot portion 8 so as to rotate relative to the foot portion 8 around hinges 16 which define a rotation axis X-X.

In particular, the leg portion may rotate forward towards a tip 20 of the boot 4 and backward towards the heel 24 of the boot 4.

The type of hinge 16 may be different; preferably there are two hinges 16 arranged on opposite sides with respect to the leg portion 12.

The hinges 16 identify a rotation axis X-X which may, in one embodiment, be horizontal, i.e., parallel to the sole 24 of the boot 4.

The leg portion 12 comprises a closing lever 28 suitable to selectively lock and/or unlock the rotation of the leg portion 12 with respect to the foot portion 8, depending on whether the user wishes to pass from a skiing configuration to a walking configuration, respectively, In the skiing configuration, the leg portion 12 will be locked with respect to the boot 4, while in the walking configuration, the leg portion 12 will be free to rotate back and forth, around the relative hinges 16, so as to support the natural rotation of the user's ankle as much as possible.

The closing lever 28 is operatively connected to a base 32 and to an arm 36, engageable in abutment against a pin 40 fixed to the foot portion 8.

The closing lever 28 and the arm 36 are integral with the leg portion 12, while the pin is integral with the foot portion 8.

In particular, the closing lever 28, in the transition from the open configuration to the closed configuration, reciprocally moves the base 32 and the arm 36 apart from each other, abutting the latter against the pin 40 to prevent a backward rotation of the leg portion 12.

The pin 40 is a cylindrical element arranged along a transverse direction T-T, substantially perpendicular to the arm 36.

Said transverse direction may be, for example, parallel and offset with respect to the rotation axis X-X defined by the hinges 16.

Preferably a lower end 42 of the arm is counter-shaped with respect to the geometry of the pin 40; for example, said lower end 42 comprises a semi-cylindrical wall so as to achieve a partial shape-coupling with the same pin.

The boot further comprises traction means 44 which operatively connect the base 32, the arm 36 and a fastening 48 on the foot portion 8 to each other.

In particular, the arm 36 is interposed between the base 32 and the fastening 48, so as to prevent also the forward rotation of the leg portion 12.

Said traction means (44) are sized and/or configured so as to go into traction in the closed configuration of the closing lever 28.

Said traction means 44 comprise an at least partially extensible cable 52.

According to a possible embodiment, the cable 52 is a metallic cable comprising a plurality of metallic strands wound between them.

Preferably, the extensibility of the cable 52 is between 0.1 and 3% of the total length of the cable itself.

According to one embodiment, the cable 52 is a single element, wound around the fastening 48 and the base 32 so as to push both of them against the interposed arm 36, comprising two separate ends 56, 60, attached to the arm 36 on the side opposite the pin 40.

For example, said two separate ends 56,60 are fixed to the arm 36 with adjustable connection means (not shown), to modify the tension of the cable itself.

Preferably, said separate ends terminate with barrels 61, which perform the function of undercuts with respect to holes formed inside the arm 36. It should be noted that these barrels 61 provide limit stops in the traction of the cable 52, so that the respective ends 56,60 remain locked due to the undercut. The same ends 56,60 may, however, slide inside the arm 36, accompanying the opening movement of the closing lever 28; in this way, the cable 52, in the opening configuration, does not tend to flex or bend, but rather runs freely inside the arm itself.

Preferably, the cable 52 comprises two branches 64,68 wound on the base 32, housed in separate grooves 72 formed in the base 32 or in the leg portion 12.

According to one possible embodiment, the traction means 44 comprise at least one element yielding elastically 70 in a controlled manner, placed in series with the cable 52 so as to allow a controlled rotation, backwards and forwards, of the leg portion 12 with respect to the foot portion 8 in the closed configuration of the closing lever 28.

According to one possible embodiment, the traction means 44 comprise at least one element yielding elastically 70 in a controlled manner, placed in series with the arm 36, so as to allow a controlled rotation, backwards and forwards, of the leg portion 12 with respect to the foot portion 8 in the closed configuration of the closing lever 28.

According to one possible embodiment, the traction means 44 comprise at least one element yielding elastically 70 in a controlled manner, placed at the attachment of the pin 40 so as to allow a controlled rotation, backwards and forwards, of the leg portion 12 with respect to the foot portion 8 in the closed configuration of the closing lever 28.

According to one possible embodiment, the traction means 44 comprise at least one element yielding elastically 70 in a controlled manner, placed on the base 32 so as to allow a controlled rotation, backwards and forwards, of the leg portion 12 with respect to the foot portion 8 in the closed configuration of the closing lever 28.

The base 32 comprises a small, shaped plate 76, sliding along a sliding direction substantially parallel to the arm 36, provided with at least one groove 72, preferably two grooves 72, for receiving and guiding a portion of the cable 52.

The presence of two grooves 72, each of which houses a portion of cable 52 terminating with a different end 56,60, facilitates the distribution of traction loads on the cable and thus improves the mechanical strength of the traction means 44.

The closing lever 28 comprises a pair of rods hinged to each other, wherein a first rod 80 is hinged and integral with the base 32 and a second rod 84 is hinged and integral with the arm 36.

The first rod 80 is provided with a gripping portion 88 or handle for a user.

The second rod 84 is guided along a longitudinal slot 92 formed on a plate 96 of the leg portion directly facing the arm 36.

The fastening is preferably made on the foot portion 8, near the heel 24, and includes a protuberance 100 with a seat 104, which houses a portion of the cable 52.

Preferably, the protuberance 100 supports the pin 40.

According to one possible embodiment, the cable 52 is at least partially housed inside the arm 36, for example by means of a perimeter seat formed on an external perimeter wall of the arm 36; in this way, the aesthetics are improved, as it hides the presence of the cable itself, and the cable 52 is protected from possible impacts with external bodies, improving the strength and reliability of the traction means 44.

The operation of a boot according to the present invention will now be described.

In particular, in the configuration with the closing lever 28 open, the leg portion is free to rotate about the respective hinges 16 along the rotation axis X-X. The rotation movement of the leg portion will be guided by the rotation of the user's ankle.

When the closing lever 28 is moved into the closed position, for example by lowering the gripping portion 88, the traction means 44 are placed in traction by pushing the base 32 and the arm 36 away from each other: in this way, the cable 52 is tightened and put in traction. At the same time, the second rod 84 pushes the arm 36 downwards, i.e., towards the heel 24, the arm being held against the pin 40. The tensioning of the cable 52 and the arm 36 being held against the pin 40 ensure the rotation of the leg portion 12 with respect to the foot portion 8 is blocked.

In effect, the backward rotation of the leg portion 12 is prevented by the arm 36 being held against the pin 40 attached to the foot portion 8.

The forward rotation is in turn blocked by the base 32, which tightens the cable 52 against the fastening 48, arranged on the side of the heel 24.

The only micro-movements of the leg portion 12 with respect to the foot portion 8 that may be obtained in the closing configuration of the closing lever 28 are from the controlled elastic deformation of the cable 52 and/or of the traction means 44, as described above.

Such movements are practically imperceptible and serve to improve user comfort, to dampen tension peaks on the members of the boot during use, and/or to absorb tolerances and play dimensions of the traction means 44.

As may be appreciated from that which has been described, the alpine/mountaineering ski boot according to the invention overcomes the drawbacks of the prior art.

In particular, in the open or unlocked configuration, the user does not meet obvious resistance in the rotation of the leg portion with respect to the foot portion, since the leg portion does not encounter any obstacles to rotation in any rotation direction thereof.

Moreover, the locking of leg portion to the foot portion is rigid and does not provide any obvious play, as in prior solutions provided with a perforated rod and relative locking pin.

In effect, the solution of the present invention comprises the presence of two unilateral constraints, separate and opposite to each other, in such a way that each of them stops a rotation direction of the leg portion with respect to the foot portion.

In particular, the forward rotation is blocked by means of the tie rods which lock the position of the backing and return plate, fixed to the leg portion, unloading the compression force onto the foot portion by means of the rod.

The backward rotation of the leg portion is blocked by the same rod which is held, in compression, against the pin.

It should be noted that the tie rod has a certain controlled elasticity.

For example, such elasticity, in the case of tie rods made of intertwined strands, is obtained by partially unrolling the strands when subjected to traction load. The same effect may, as seen, be obtained by means of a cable yielding in a controlled manner. This controlled yielding is sufficient to dampen slightly the stresses and any shocks discharged from the leg portion onto the rod, the backing and return plate and/or the pin.

Such controlled yielding improves the comfort of the boot in the skiing configuration and increases the mechanical strength thereof even after heavy and intense use.

Moreover, the controlled yielding of the tie rod or other components of the ski-walk mechanism allows any constructive play of the leg portion, of the foot portion, and/or of the ski-walk mechanism itself to be absorbed.

Moreover, the controlled yielding facilitates the movement of the closing lever by a user who may open and close it repeatedly, without excessive effort, even while wearing gloves.

Moreover, due to the solution of the present invention, there are no particular constraints for positioning the hinges of the leg portion with respect to the foot portion: in this way, the designer has more design freedom.

A person skilled in the art, in order to satisfy contingent and specific needs, may make numerous modifications and variations to the boots described above, all of which are within the scope of the invention defined by the following claims.

The invention claimed is:

1. A ski boot comprising a lower part or foot portion suitable to enclose the user's foot and an upper part or leg portion suitable to enclose the lower part of the user's leg, wherein the leg portion is hinged to the foot portion so as to rotate in relation to the foot portion around a hinge defining a rotation axis, forwards, toward a tip of the boot, and backwards toward a heel of the boot, wherein the leg portion comprises a closing lever suitable for selectively blocking and/or unblocking the rotation of the leg portion in relation to the foot portion depending on whether the user wishes to pass from a skiing configuration to a walking configuration, respectively, wherein the closing lever is operatively connected to a base and to an arm engageable in abutment against a pin fixed to the foot portion, wherein the closing lever, in the transition from the open configuration to the closed configuration reciprocally distances the base and the arm from each other abutting the latter against the pin to prevent a backward rotation of the leg portion, traction means operatively connecting the base, the arm and a fastening on the foot portion to each other, the arm being placed between the base and the fastening in order to also prevent the forward rotation of the leg portion, said traction means comprising a cable at least partially extensible, wherein the cable is the only element, wound around the fastening and the base so as to push both the fastening and the base against the arm, which is interposed between the fastening and the base, said cable comprising two separate ends, attached to the arm on the side opposite the pin.

2. The ski boot according to claim 1, wherein the extensibility of the cable is between 0.1 and 3% of the length of the cable itself.

3. The ski boot according to claim 1, wherein said two separate ends are attached to the arm by adjustable connection means, to change the tension of the cable.

4. The ski boot according to claim 1, wherein the cable comprises two branches wound on the base, housed in separate grooves made on the base.

5. Ski boot according to claim 1, wherein the traction means comprise at least one element yielding elastically in a controlled manner, placed in series with the cable so as to allow a controlled rotation, backwards and forwards, of the leg portion with respect to the foot portion in the closed configuration of the closing lever.

6. Ski boot according to claim 1, wherein the traction means comprise at least one element yielding elastically in a controlled manner, placed in series with the arm so as to allow a controlled rotation, backwards and forwards, of the leg portion with respect to the footportion in the closed configuration of the closing lever.

7. Ski boot according to claim 1, wherein the traction means comprise at least one element yielding elastically in a controlled manner, placed at the attachment of the pin so as to allow a controlled rotation, backwards and forwards, of the leg portion with respect to the foot portion, in the closed configuration of the closing lever.

8. The ski boot according to claim 1, wherein the traction means comprise at least one element yielding elastically in a controlled manner, placed on the base so as to allow a controlled rotation, backwards and forwards, of the leg portion with respect to the foot portion, in the closed configuration of the closing lever.

9. The ski boot according to claim 1, wherein said traction means are sized and/or configured so as to go into traction in the closed configuration of the closing lever.

10. A ski boot comprising a lower part or foot portion suitable to enclose the user's foot and an upper part or leg portion suitable to enclose the lower part of the user's leg, wherein the leg portion is hinged to the foot portion so as to rotate in relation to the foot portion around a hinge defining a rotation axis, forwards, toward a tip of the boot, and backwards toward a heel of the boot, wherein the leg portion comprises a closing lever suitable for selectively blocking and/or unblocking the rotation of the leg portion in relation to the foot portion depending on whether the user wishes to pass from a skiing configuration to a walking configuration, respectively, wherein the closing lever is operatively connected to a base and to an arm engageable in abutment against a pin fixed to the foot portion, wherein the closing lever, in the transition from the open configuration to the closed configuration reciprocally distances the base and the arm from each other abutting the latter against the pin to prevent a backward rotation of the leg portion, traction means operatively connecting the base, the arm and a fastening on the foot portion to each other, the arm being placed between the base and the fastening in order to also prevent the forward rotation of the leg portion, said traction means comprising a cable at least partially extensible, wherein the closing lever comprises a pair of rods hinged to each other, wherein a first rod is hinged and integral with the base and a second rod is hinged and integral with the arm.

11. The ski boot according to claim 10, wherein the first rod is fitted with a gripping portion for a user.

12. The ski boot according to claim 10, wherein the second rod is guided along a longitudinal slot made on a plate of the leg portion directly facing the arm.

13. A ski boot comprising a lower part or foot portion suitable to enclose the user's foot and an upper part or leg portion suitable to enclose the lower part of the user's leg, wherein the leg portion is hinged to the foot portion so as to rotate in relation to the foot portion around a hinge defining a rotation axis, forwards, toward a tip of the boot, and backwards toward a heel of the boot, wherein the leg portion comprises a closing lever suitable for selectively blocking and/or unblocking the rotation of the leg portion in relation to the foot portion depending on whether the user wishes to pass from a skiing configuration to a walking configuration, respectively, wherein the closing lever is operatively connected to a base and to an arm engageable in abutment against a pin fixed to the foot portion, wherein the closing lever, in the transition from the open configuration to the closed configuration reciprocally distances the base and the arm from each other abutting the latter against the pin to prevent a backward rotation of the leg portion, traction means operatively connecting the base, the arm and a fastening on the foot portion to each other, the arm being placed between the base and the fastening in order to also prevent the forward rotation of the leg portion, said traction means comprising a cable at least partially extensible wherein said fastening is made on the foot portion, near the heel, said fastening comprising a protuberance with a seat which houses a portion of the cable.

14. The ski boot according to claim 13, wherein said protuberance supports the pin.

15. A ski boot comprising a lower part or foot portion suitable to enclose the user's foot and an upper part or leg portion suitable to enclose the lower part of the user's leg, wherein the leg portion is hinged to the foot portion so as to rotate in relation to the foot portion around a hinge defining a rotation axis, forwards, toward a tip of the boot, and backwards toward a heel of the boot, wherein the leg portion comprises a closing lever suitable for selectively blocking and/or unblocking the rotation of the leg portion in relation to the foot portion depending on whether the user wishes to pass from a skiing configuration to a walking configuration, respectively, wherein the closing lever is operatively connected to a base and to an arm engageable in abutment against a pin fixed to the foot portion, wherein the closing lever, in the transition from the open configuration to the closed configuration reciprocally distances the base and the arm from each other abutting the latter against the pin to prevent a backward rotation of the leg portion, traction means operatively connecting the base, the arm and a fastening on the foot portion to each other, the arm being placed between the base and the fastening in order to also prevent the forward rotation of the leg portion, said traction means comprising a cable at least partially extensible, wherein said cable is at least partially housed inside the arm.

* * * * *